US012435478B2

(12) United States Patent
Yang et al.

(10) Patent No.: US 12,435,478 B2
(45) Date of Patent: Oct. 7, 2025

(54) SUSPENSION CABLE REPLACEMENT DEVICE

(71) Applicants: Railway No. 10 Engineering Group Co., Ltd., Jinan (CN); Sichuan Huaqi Construction Engineering Co., Ltd., Chengdu (CN)

(72) Inventors: Feilong Yang, Zhengzhou (CN); Pandeng Xie, Zhengzhou (CN); Haibo Xiao, Zhengzhou (CN); Zeping Yang, Zhengzhou (CN); Dawei Ding, Zhengzhou (CN); Zhibo Wang, Zhengzhou (CN); Peijun Zhou, Zhengzhou (CN)

(73) Assignees: RAILWAY NO. 10 ENGINEERING GROUP CO., LTD., Jinan (CN); SICHUAN HUAQI CONSTRUCTION ENGINEERING CO., LTD., Chengdu (CN)

( * ) Notice: Subject to any disclaimer, the term of this patent is extended or adjusted under 35 U.S.C. 154(b) by 954 days.

(21) Appl. No.: 17/563,013

(22) Filed: Dec. 27, 2021

(65) Prior Publication Data

US 2023/0062490 A1 Mar. 2, 2023

(30) Foreign Application Priority Data

Aug. 27, 2021 (CN) ..... 202122042227.0

(51) Int. Cl.

| | |
|---|---|
| ***E01D 11/04*** | (2006.01) |
| ***E01D 19/16*** | (2006.01) |
| ***E01D 21/00*** | (2006.01) |

(52) U.S. Cl.

CPC ..... *E01D 11/04* (2013.01); *E01D 21/00* (2013.01); *E01D 19/16* (2013.01)

(58) Field of Classification Search

CPC ..... E01D 11/00; E01D 11/02; E01D 11/04; E01D 19/16; E01D 21/00

See application file for complete search history.

(56) References Cited

FOREIGN PATENT DOCUMENTS

| | | | | |
|---|---|---|---|---|
| AU | 2019286812 A1 | * | 1/2021 | ..... E01D 22/00 |
| CN | 102286944 A | * | 12/2011 | |
| CN | 202214682 U | * | 5/2012 | |
| CN | 216999368 U | * | 7/2022 | |
| CN | 115125857 A | * | 9/2022 | ..... E01D 21/00 |

(Continued)

*Primary Examiner* — Abigail A Risic

(74) *Attorney, Agent, or Firm* — MATTHIAS SCHOLL P.C.; Matthias Scholl

(57) ABSTRACT

A suspension cable replacement device includes a power unit and a plurality of adjustment units. The plurality of adjustment units is disposed around a suspension cable to be replaced. The power unit is configured to power the plurality of adjustment units. Each adjustment unit includes a support frame, a connector, and a steel strand. The power unit includes two jacks each including a main body. The support frame includes two support columns, a top part, and a bottom part. The top part includes a first through hole, and a nut fixed on an anchor is disposed in the first through hole; a hanger rod is disposed through the anchor and the nut, and fixed in the nut. The bottom part includes a second through hole, and the steel strand is disposed through the second through hole. The connector is disposed in the central cavity of the support frame.

7 Claims, 1 Drawing Sheet

(56) References Cited

FOREIGN PATENT DOCUMENTS

| | | | | | |
|---|---|---|---|---|---|
| CN | 219908637 | U | * | 10/2023 | |
| CN | 117107676 | A | * | 11/2023 | ..... E01D 22/00 |
| JP | 2019143377 | A | * | 8/2019 | |

* cited by examiner

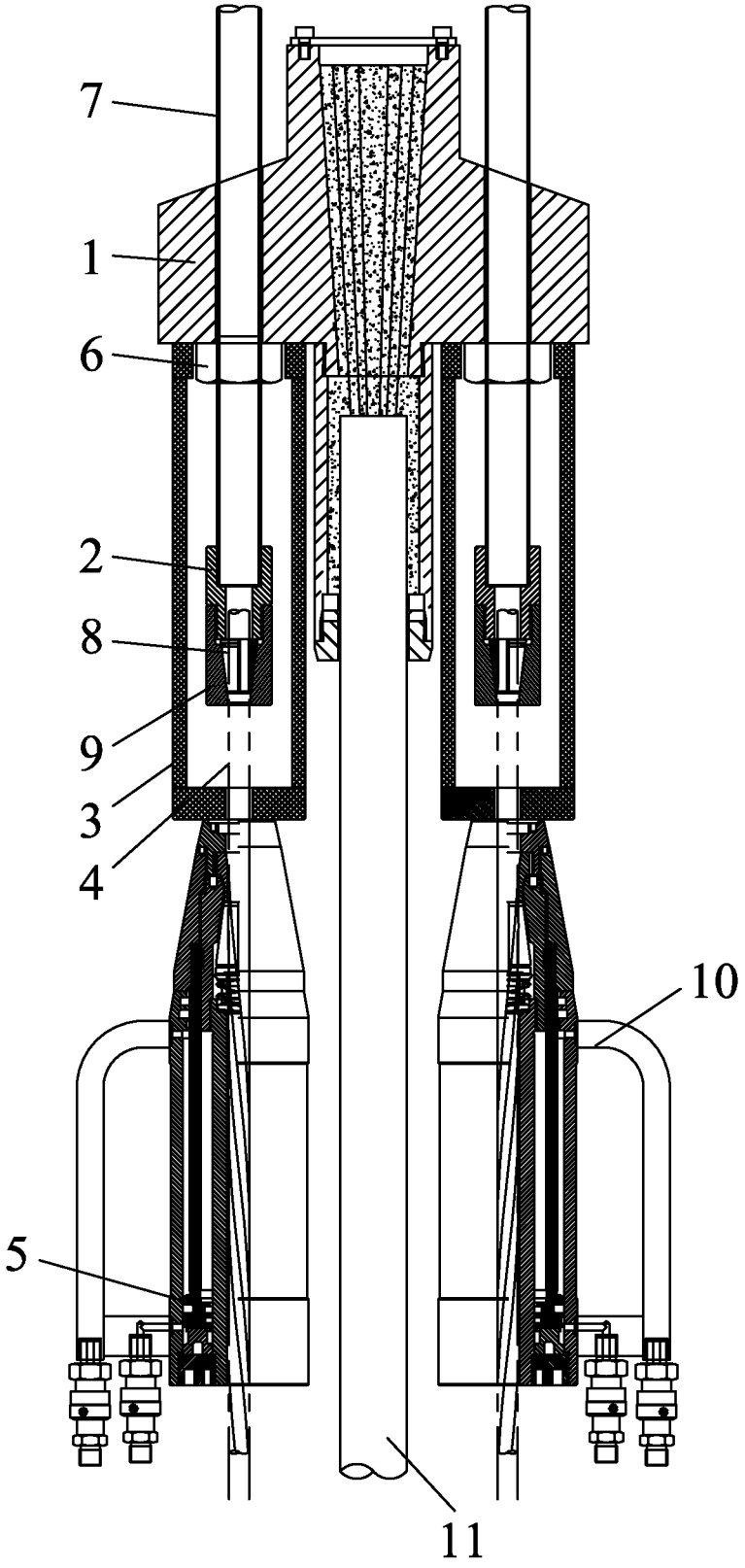
7
1
6
2
8
9
3
4
10
5
11

SUSPENSION CABLE REPLACEMENT DEVICE

CROSS-REFERENCE TO RELATED APPLICATIONS

Pursuant to 35 U.S.C. § 119 and the Paris Convention Treaty, this application claims foreign priority to Chinese Patent Application No. 202122042227.0 filed Aug. 27, 2021, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a suspension cable replacement device.

For conventional suspension bridges, main cables are equipped with clamps and suspension cables are equipped with anchors. The clamps are respectively connected to corresponding suspension cables by U-bolts. The suspension cables are erected or swapped out by means of pocket hanging or temporary hanger rods. For the accurate erection of the cables, the load data of suspension bridges in each construction stage should be analyzed to determine the tension and length of new suspension cables, thus maintaining a stable spatial structure of the main cables and the deck. The above methods combined with manual measurement are not easy to control the height of pocket hanging and temporary hanger rods, which may result in low accuracy, high labor cost, and long construction time.

SUMMARY

The disclosure provides a suspension cable replacement device; the suspension cable replacement device comprises a power unit and a plurality of adjustment units; the plurality of adjustment units is disposed around a suspension cable to be replaced; the power unit is configured to power the plurality of adjustment units; each of the plurality of adjustment units comprises a support frame, a connector, and a steel strand; the power unit comprises two jacks each comprising a main body; the support frame is door-shaped and comprises two support columns, a top part, and a bottom part; the top part comprises a first through hole, and a nut fixed on an anchor is disposed in the first through hole; a hanger rod is disposed through the anchor and the nut, and fixed in the nut; the bottom part comprises a second through hole, and the steel strand is disposed through the second through hole; the connector is disposed in the central cavity of the support frame; one end of the connector is screwed to a first end of the hanger rod; a second end of the connector is fixedly connected to one end of the steel strand; another end of the steel strand is fixedly connected to the main body of each jack; the bottom part of the support frame abuts against a top surface of each jack; and the top part of the support frame abuts against a bottom surface of the anchor.

In a class of this embodiment, each of the two jacks is a hydraulic jack; the power unit further comprises a hydraulic hose and a post-tension stressed oil pump; each hydraulic jack comprises an oil inlet and the post-tension stressed oil pump comprises an oil outlet; and the oil outlet is connected to the oil inlet through the hydraulic hose.

In a class of this embodiment, the power unit further comprises a three-way hydraulic connector disposed between the post-tension stressed oil pump and the two hydraulic jacks.

In a class of this embodiment, the suspension cable replacement device comprises two adjustment units disposed symmetrically about the suspension cable.

In a class of this embodiment, the connector is an anchorage connector.

In a class of this embodiment, each of the two jacks is a core-through hydraulic jack; and the steel strand passes through each core-through hydraulic jack.

In a class of this embodiment, the second through hole is disposed in the center of the bottom part of the support frame and is aligned with the core-through hydraulic jack.

The following advantages of the disclosure is associated with the suspension cable replacement device of the disclosure: the suspension cable replacement device comprises a post-tension stressed oil pump, a three-way hydraulic connector, two jacks, two support frames, and a connector. An anchor abuts against the top surfaces of the two support frames, and the bottom surfaces of the two support frames abut against the top surfaces of the two jacks, respectively. The connector is connected to the hanger rod and the steel strand is connected to the jack. When the two jacks are operated, a displacement between the suspension cable and the anchor is produced, forming a gap between the nut and the anchor and thus allowing convenient disassembly of the suspension cable. The replacement process is performed by hydraulic pressure so that the tensioning distance can be precisely controlled. The suspension cable replacement device offers advantages such as simple structure, easy operation, convenient assembly, disassembly, and movement of U-shaped or straight hanger rod, which can accurately and quickly determine the tension and unstressed length of the suspension cable and increase the adjustment range, thus allowing the construction indicators of the suspension bridge to meet the specifications and design requirements.

DETAILED DESCRIPTION

The disclosure is described hereinbelow with reference to accompanying drawings, in which the sole figure is a perspective view of a suspension cable replacement device according to one example of the disclosure.

Detailed Description

To further illustrate the disclosure, embodiments detailing a suspension cable replacement device are described below. It should be noted that the following embodiments are intended to describe and not to limit the disclosure.

As shown in FIG. 1, a suspension cable replacement device comprises a power unit and a plurality of adjustment units. The plurality of adjustment units is disposed around a suspension cable 11 to be replaced. The power unit is configured to provide power the plurality of adjustment units. The plurality of adjustment units comprises a support frame 3, a connector 2, and a steel strand 4. The power unit comprises two jacks 5 each comprising a main body. The support frame 3 is door-shaped and comprises two support columns, a top part, and a bottom part. The top part comprises a first through hole through which a hanger rod 7 is fixedly connected to an anchor 1 by a nut 6. The bottom part comprises a second through hole, and the steel strand is disposed through the second through hole 4. The connector 2 is disposed in the central cavity of the support frame 3. One end of the connector 2 is screwed into a first end of the hanger rod 7. A second end of the connector 2 is fixedly connected to one end of the steel strand 4. Another end of the steel strand 4 is fixedly connected to the main body of each jack 5. The bottom part of the support frame 3 abuts against a top surface of each jack 5. The top part of the support frame 3 abuts against a bottom surface of the anchor 1.

The plurality of adjustment units acts to cause dislocation and reduce the tension force between the anchor 1 and the hanger rod 7, thus allowing for quick and easy disassembly of the anchor 1 and the hanger rod 7. The two jacks 5 are configured to ensure accuracy and stability in controlling the dislocation, thus allowing for easy removal, erection, or adjustment of the suspension cable 11.

In certain examples, each of the two jacks 5 is a hydraulic jack; the power unit further comprises a hydraulic hose and a post-tension stressed oil pump; each hydraulic jack comprises an oil inlet and the post-tension stressed oil pump comprises an oil outlet; the oil outlet is connected to the oil inlet through the hydraulic hose; the power unit further comprises a three-way hydraulic connector disposed among the post-tension stressed oil pump and the two hydraulic jacks; and the plurality of adjustment units are controlled synchronously in such a manner that eliminates errors caused by independent operation of the plurality of adjustment units.

In certain examples, the suspension cable replacement device comprises two adjustment units disposed symmetrically about the suspension cable 11. In use, the two adjustment units are disposed according to their type and size.

The connector 2 is an anchorage connector that is fastened to an anchorage clip 8 and a single-hole anchorage 9 to form a stable structure. The stable structure is easy to assemble and disassemble, well known in the related arts, and accordingly not described further herein. Each of the two jacks 5 is a core-through hydraulic jack. The steel strand 4 is passed through each core-through hydraulic jack to pull the hanger rod 7. The steel strand 4 is subjected to a tension force and applies a pulling force in the opposite direction on the hanger rods. The pulling process may be unstable when an ordinary jack is configured to pull the steel strand from one side.

In use, the support frame 3 is disposed under the anchor; a first end of a U-shaped or straight hanger rod 7 is disposed through the first through hole and temporarily held by a chain hoist; the connector 2 is disposed into the bottom part of the support frame 3 and is secured to the first end of the U-shaped or straight hanger rod 7; the steel strand 4 is disposed through the second through hole to secure to each jack 5; each jack 5 is temporarily held by the chain hoist; the chain hoist is configured to adjust the position of the support frame 3 and the two jacks 5. When the post-tension stressed oil pump is energized and two jacks are operated, the nut gets loose, thus allowing removal of the U-shaped hanger rod and adjustment of the length of the straight hanger rod.

The suspension cable replacement device is suitable for use in any work relating to suspension cables, does not involve any temporary suspension cables, and takes less space than the related arts. An equal force acts on both sides of the U-shaped or straight hanger rod to increase adjustment range and allow for convenient assembly or disassembly of the suspension cable. The unstressed length and tension of the suspension cable are controlled finely with the help of the suspension cable replacement device. For construction work with greater tension of a suspension cable, the steel strand 4 can be replaced with a screw-thread steel bar. The nut is removed or fixed by lifting or lowering it to a height via numerical control so as to determine the tension and length of the U-shaped or straight hanger rod, minimize the construction errors, and shorten the construction period.

It will be obvious to those skilled in the art that changes and modifications may be made, and therefore, the aim in the appended claims is to cover all such changes and modifications.

What is claimed is:

1. A device, comprising:

a power unit; and a plurality of adjustment units;

wherein:

the plurality of adjustment units is disposed around a suspension cable to be replaced; the power unit is configured to power the plurality of adjustment units;

each of the plurality of adjustment units comprises a support frame, a connector, and a steel strand;

the power unit comprises two jacks, each jack comprising a main body;

the support frame is door-shaped and comprises two support columns, a top part, and a bottom part; the top part comprises a first through hole, and a nut fixed on an anchor is disposed in the first through hole; a hanger rod is disposed through the anchor and the nut, and fixed in the nut;

the bottom part comprises a second through hole, and the steel strand is disposed through the second through hole;

the connector is disposed in a central cavity of the support frame; one end of the connector is screwed to a first end of the hanger rod, and a second end of the connector is fixedly connected to one end of the steel strand; another end of the steel strand is fixedly connected to the main body of each jack; and the bottom part of the support frame abuts against a top surface of each jack; and the top part of the support frame abuts against a bottom surface of the anchor.

2. The device of claim 1, wherein each of the two jacks is a hydraulic jack; the power unit further comprises a hydraulic hose and a post-tension stressed oil pump; each hydraulic jack comprises an oil inlet and the post-tension stressed oil pump comprises an oil outlet; and the oil outlet is connected to the oil inlet through the hydraulic hose.

3. The device of claim 2, wherein the power unit further comprises a three-way hydraulic connector disposed between the post-tension stressed oil pump and the two hydraulic jacks.

4. The device of claim 1, wherein the device comprises two adjustment units disposed symmetrically about the suspension cable.

5. The device of claim 4, wherein the connector is an anchorage connector.

6. The device of claim 5, wherein each of the two jacks is a core-through hydraulic jack; and the steel strand passes through each core-through hydraulic jack.

7. The device of claim 6, wherein the second through hole is disposed in a center of the bottom part of the support frame and is aligned with the core-through hydraulic jack.

* * * * *